US005665040A

United States Patent [19]

Ho

[11] Patent Number: 5,665,040

[45] Date of Patent: Sep. 9, 1997

[54] ELASTIC CORD MEMBER AND CONNECTOR ARRANGEMENT

[76] Inventor: Charles Ho, Room 3E45, No. 5, Sec. 5, Hsing Yi Road, Taipei, Taiwan

[21] Appl. No.: 677,235

[22] Filed: Jul. 9, 1996

[51] Int. Cl.[6] ..... A63B 21/02

[52] U.S. Cl. ..... 482/126; 482/121

[58] Field of Search ..... 482/121, 122, 482/123, 124, 125, 126, 129, 130, 82; 403/349

[56] References Cited

U.S. PATENT DOCUMENTS

| | | | |
|---|---|---|---|
| 3,528,656 | 9/1970 | Haanen | 482/126 |
| 4,176,815 | 12/1979 | Davidson et al. | 403/349 |
| 5,362,295 | 11/1994 | Nurge | 482/121 |

*Primary Examiner*—Lynne A. Reichard
*Attorney, Agent, or Firm*—Bacon & Thomas

[57] ABSTRACT

An elastic cord member and connector arrangement includes a connector having a coupling hole and two opposite notches at two opposite sides of said coupling hole and two opposite notches at two opposite sides of said coupling hole, an elastic cord member, and a coupling hole and two opposite notches at two opposite side of said coupling hole, an elastic cord member, and a coupling socket fixedly secured to one end of the elastic cord member and detachably coupled to the coupling hole of the connector by way of a spring supporting one end on the inside of the coupling hole of the connector, and by way of two locating lugs raised from the periphery at two opposite sides and adapted for inserting into notches of the coupling hole of the connector. The connector has two L-shaped locating holes vertically spaced at two opposite sides and arranged in reversed directions and respectively disposed in communication with the notches of the coupling hole of the connector. Each of the L-shaped locating holes has a length extending over the corresponding notch of the coupling hole, a depth extending over the bottom side of the corresponding notch of the coupling hole, and a width longer than the depth of the locating lugs of the coupling socket, so that the locating lugs of said coupling socket can be forced into engagement with the L-shaped locating holes by turning the coupling socket in the coupling hole of the connector.

2 Claims, 3 Drawing Sheets

ELASTIC CORD MEMBER AND CONNECTOR ARRANGEMENT

BACKGROUND OF THE INVENTION

The present invention relates to an elastic cord member and connector arrangement which comprises a connector having a coupling hole and two L-shaped locating holes vertically spaced from the coupling hole at two opposite sides and arranged in reversed direction, an elastic cord having a coupling socket at one end adapted for inserting into the coupling hole of the connector and forced into engagement with the L-shaped locating holes through a rotary motion.

Elastic cords are intensively used in gymnastic apparatus for stretching by force. Conventionally, clips or hooks are used to fasten the ends of elastic cords to grips or locating means. However, these elastic cord mounting devices are complicated to install. There are screw joints developed for securing elastic cords to grips or locating means. However, these screw joints are complicated to manufacture. When installed, the tension of the elastic cords cannot be conveniently adjusted.

SUMMARY OF THE INVENTION

The present invention provides an elastic cord member and connector arrangement which permits the elastic cord to be quickly and detachably installed. According to the preferred embodiment of the present invention, the elastic cord member and connector arrangement comprises a connector having a coupling hole and two opposite notches at two opposite sides of said coupling hole, an elastic cord member, and a coupling socket fixedly secured to one end of the elastic cord member and detachably coupled to the coupling hole of the connector, the coupling socket having a spring at one end adapted for supporting on the inside of the coupling hole of the connector, and two locating lugs raised from the peripheral at two opposite sides and adapted for inserting into the notches of the coupling hole of the connector, wherein the connector has two L-shaped locating holes vertically spaced at two opposite sides and arranged in reversed directions and respectively disposed in communication with the notches of the coupling hole of the connector, each of the L-shaped locating holes having a length extending over the corresponding notch of the coupling hole, a depth extending over the bottom side of the corresponding notch of the coupling hole, and a width longer than the depth of the locating lugs of the coupling socket, so that the locating lugs of said coupling socket can be forced into engagement with the L-shaped locating holes by turning said coupling socket in the coupling hole of said connector.

DETAILED DESCRIPTION OF THE PREFERRED EMBODIMENT

Figure 1:
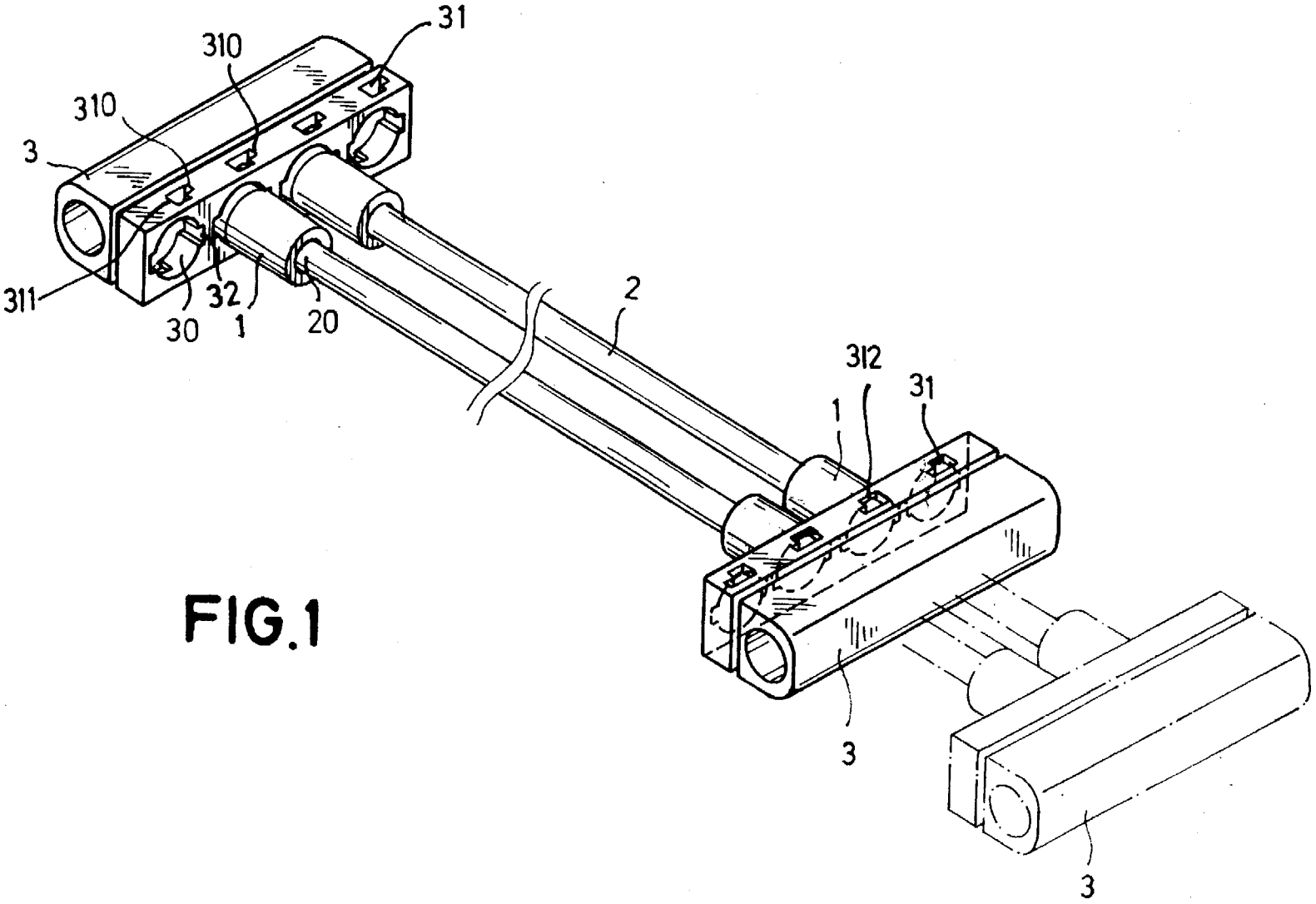
FIG. 1 is a perspective view of the preferred embodiment of the present invention.
Figure 2:
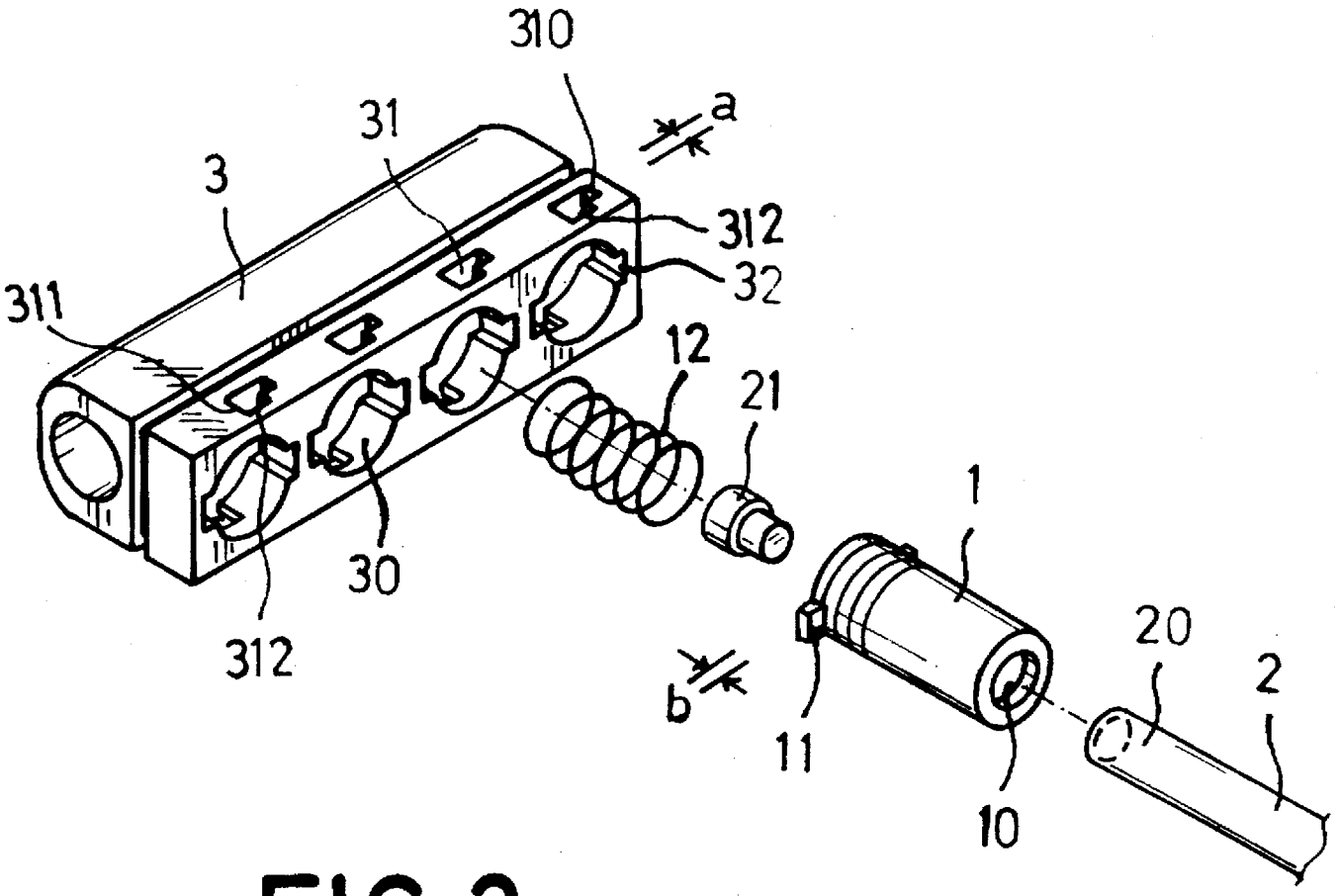
FIG. 2 is an exploded view of the preferred embodiment of the present invention.
Figure 4:
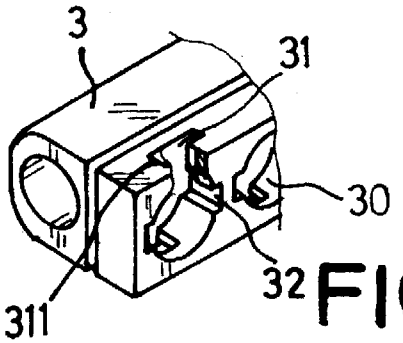
FIG. 4 is a partial view of the connector shown in FIG. 1 when viewed from another angle.
Figure 5:
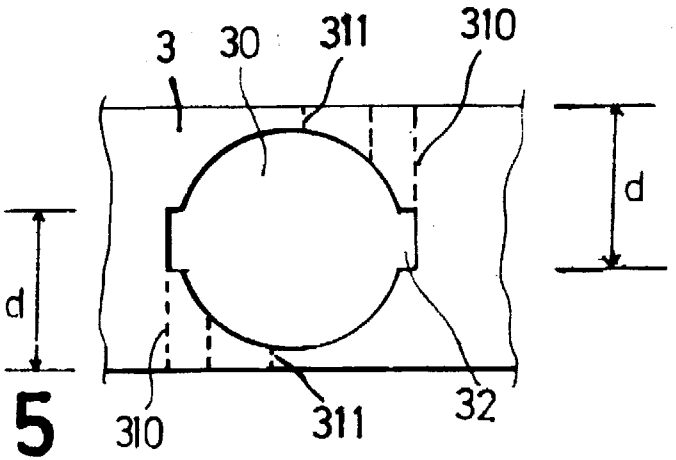
FIG. 5 is a front view of a part of the connector shown in FIG. 1, showing the relationship between the coupling hole and the L-shaped locating holes.
Figure 3:
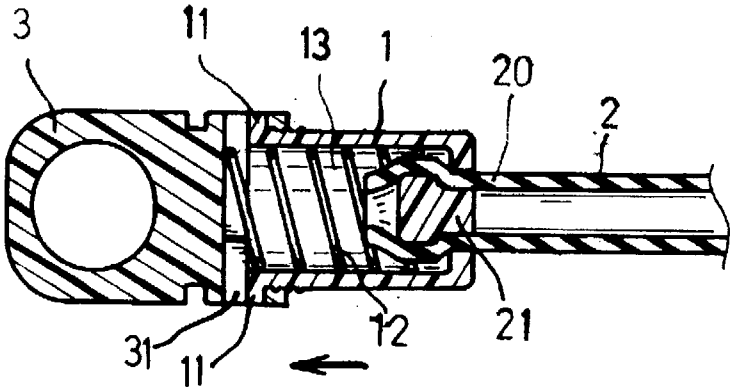
FIG. 3 is a sectional assembly view of the preferred embodiment of the present invention.

Referring to FIGS. 1 to 5, the present invention is generally comprised of a coupling socket 1, an elastic cord member 2, and a connector 3. The elastic cord member 2 can be an elastic rope or spring member, having one end 20 fixedly connected to the coupling socket 1. As an example of the present invention, a plug member 21 is fitted into the (tubular) end 20 of the elastic cord member 2 so that the end 20 is radially expanded outwards and fixedly secured to the inside of the coupling socket 1 after the elastic cord members 2 is inserted through the coupling socket 1. The coupling socket 1 has two locating lugs 11 bilaterally raised from the periphery at one end. A spring 12 is mounted in the inside chamber 13 of the coupling socket 1. The connector 3 has a coupling hole 30 adapted for receiving the coupling socket 1, two opposite notches 32 at two opposite sides of the coupling hole 30 for the passing of the locating lugs 11 of the coupling socket 1, two substantially L-shaped locating holes 31 vertically spaced at two opposite sides and arranged in reversed directions and respectively disposed in communication with the coupling hole 30. When viewing the connector 3 from the front side as shown in FIG. 5, the outer end 310 of the L-shaped locating hole 31 surpasses or at least reaches the outer end of the corresponding notch 32; the depth d of the L-shaped locating hole 31 surpasses or at least reaches the bottom side of the corresponding notch 32 (see FIG. 5); the width a (see FIG. 2) of the L-shaped locating hole 31 is longer than the thickness b (see FIG. 2) of the locating lugs 11 of the coupling socket 1.

When the coupling socket 1 is inserted into the coupling hole 30 of the connector 3, the spring 12 is stopped against the inside wall of the connector 3 and compressed, and then the coupling socket 1 is turned in the coupling hole 30 to force the locating lugs 11 into the L-shaped locating holes 31 and to stop the locating lugs 11 at the inner ends 311 of the L-shaped locating holes 31. When the hand is released from the coupling socket 1, the spring force of the spring 12 immediately forces the coupling socket 1 forwards, thereby causing the locating lugs 11 to be respectively forced into engagement with the front ends 312 of the L-shaped locating holes 31 respectively to stop the coupling socket 1 from rotary motion. Therefore, the coupling socket 1 and the elastic cord member 2 are firmly retained to the connector 3. When one wants to disconnect the coupling socket 1 from the connector 3, the aforesaid procedure is performed in reverse.

While only one embodiment of the present invention has been shown and described, it will be understood that various modifications and changes could be made without departing from the spirit and scope of the invention.

What the invention claimed is:

1. A connector assembly for elastic cord members comprising:

(a) at least one connector member having at least one coupling hole with a notch disposed at each of two opposite sides of said coupling hole, said connector member having two L-shaped locating holes arranged in opposite directions from each other, each L-shaped locating hole in communication with one of said notches, each of said L-shaped locating holes having an outer end and an inner end and a front side;

(b) at least one elastic cord member; and (c) at least one hollow substantially cylindrical coupling socket secured to said elastic cord member configured to be rotatably received in said at least one coupling hole, said coupling socket having a spring disposed so as to bear against a portion of said connector member when said at least one coupling member is inserted into said at least one coupling hole, said coupling socket having two locating lugs extending from opposite sides, said two locating lugs configured to pass through said notches when said coupling socket is inserted into said connector member through said coupling hole;

wherein inserting said coupling socket into said coupling hole causes each of said lugs to enter into said outer end of one of said L-shaped locating holes, such that rotation of said at least one coupling socket relative to the at least one connector causes each of said each locating lugs to reach said inner end of one of said L-shaped locating holes such that said spring urges said lugs against said front sides of each of said L-shaped locating holes to secure said coupling socket to said connector member.

2. The connector assembly of claim 1, wherein said at least one elastic cord member has a hollow tubular end inserted into said coupling socket, and further comprising a plug member inserted into said hollow tubular end to expand said hollow tubular end of said at least one elastic cord so as to attach the at least one elastic cord to said at least one coupling socket.

* * * * *